US006223513B1

(12) United States Patent
Post et al.

(10) Patent No.: US 6,223,513 B1
(45) Date of Patent: May 1, 2001

(54) FLYER BOW WITH INTEGRAL ENCLOSED WIRE GUIDE

(75) Inventors: Jeffrey M. Post, South Windsor; David Rowlands, Broad Brook; Mark Broding, Windsor, all of CT (US)

(73) Assignee: Kamatics Corporation, Bloomfield, CT (US)

( * ) Notice: Subject to any disclaimer, the term of this patent is extended or adjusted under 35 U.S.C. 154(b) by 0 days.

(21) Appl. No.: 09/448,263

(22) Filed: Nov. 24, 1999

(51) Int. Cl.[7] ..... D04H 7/26
(52) U.S. Cl. ..... 57/115
(58) Field of Search ..... 57/58.83, 58.63, 57/115, 352, 357, 61

(56) References Cited

U.S. PATENT DOCUMENTS

| | | | |
|---|---|---|---|
| 6,461 | 5/1849 | Abbot . | |
| 81,064 | 8/1868 | Bolster . | |
| 1,512,220 * | 10/1924 | Harnett | 57/115 |
| 2,599,356 | 6/1952 | Wild . | |
| 3,019,590 | 2/1962 | Brame . | |
| 3,413,795 | 12/1968 | Breuning . | |
| 3,945,182 | 3/1976 | Dover et al. . | |
| 4,072,003 | 2/1978 | Mino . | |
| 4,302,924 | 12/1981 | Faulstich . | |
| 4,434,945 | 3/1984 | Hamane et al. . | |
| 5,509,260 | 4/1996 | Derdeyn . | |
| 5,809,763 | 9/1998 | Rowlands et al. . | |

FOREIGN PATENT DOCUMENTS

| | | |
|---|---|---|
| 618 486 A5 | 7/1980 | (CH) . |
| 0 569 730 A1 | 11/1993 | (EP) . |
| 5-247861A | 9/1993 | (JP) . |

* cited by examiner

*Primary Examiner*—Danny Worrell
(74) *Attorney, Agent, or Firm*—Cantor Colburn, LLP

(57) ABSTRACT

An exemplary embodiment of the present invention is a flyer bow having a first surface and a second surface in opposition to the first surface. The first and second surfaces are joined to form an airfoil shape. A channel passes through the flyer bow between the first and second surface and a wire guide is disposed within the channel. There is at least one orifice through one of the first and second surface thereby establishing fluid communication between the channel and the ambient atmosphere.

23 Claims, 1 Drawing Sheet

FLYER BOW WITH INTEGRAL ENCLOSED WIRE GUIDE

BACKGROUND OF THE INVENTION

This invention relates to flyer bows. Flyer bows for use on twisting machines are well known in the art. Twisting machines with flyer bows can be used to make twisted cables for a wide variety of uses. Flyer bows, including those related to this invention, can be used with pairing, tripling, quadding, bunching and twisted machines for wires. A typical flyer bow is generally rectangular in cross section. Wires to be twisted pass longitudinally along the inside surface of the flyer bow and are guided along the surface through ceramic or metal wire guides. A groove or recess in the inside surface of the flyer bow is often incorporated into the design of the flyer bow in order to nest the wires to be twisted close to the surface of the flyer bow. This configuration minimizes drag on the wires due to wind that sweeps transversely across the flyer bow during use. Flyer bows with airfoil shapes have been successfully used to increase speed of the winding machines with the benefits of minimum power draw and reduced operational noise. However, the airfoil does little, if anything, to minimize the effect of drag on the exposed wires. Furthermore, the exposed wire guides create additional drag on the flyer bow as it rotates.

A typical construction and operation of a twisting machine and flyer bow is disclosed and described in U.S. Pat. No. 3,945,182, the entire contents of which are incorporated herein by reference. As described in U.S. Pat. No. 3,945,182, a typical flyer bow is arcuate along its length and transversely flat. That is, it is generally rectangular, or at least has opposed flat parallel faces, and it is arcuate along its length. U.S. Pat. No. 3,945,182 discloses the feature of incorporating a groove or recess in the inside surface of the flyer bow and a corresponding ridge or protrusion on the outer surface of the flyer bow. The wires to be twisted nest within the groove to protect the wires from windage that sweeps transversely across the flyer bow as it rotates along its orbital path around a longitudinal axis.

Typical prior art flyer bows have wire guides mounted on the inner surface. These wire guides are typically semicircular in shape and present a flat and blunt exposed air surface. The prior art wire guides are typically secured to the flyer bow by nuts which extend above the top surface of the flyer bow and are exposed to air as the flyer bow rotates. All of this creates drag of the flyer bow as it rotates.

U.S. Pat. No. 5,509,260 discloses a guiding bow for an elongated element in a twisting or winding apparatus. At least part of the length of the guiding bow has a transversal cross section which is streamlined. The core of the guiding bow may be made of a load carrying material, the sheath of a synthetic material.

U.S. Pat. No. 5,809,763 discloses a flyer bow having inner and outer surfaces, and at least one surface is curved to form an airfoil in cross section.

U.S. Pat. No. 4,072,003 discloses a double twisting machine of a flyer type, which comprises a pair of rotatable fliers, a pair of bow guides formed with a through bore for allowing wire elements to pass therethrough, two pairs of guide holders each retained in one of each of the fliers for holding one end of each of the bow guides and two pairs of shock-absorbing elastic members each interposed between each of the fliers and each of the bow guides through the corresponding one of the guide holders. The fliers are in spherical contact with the guide holders so as to assure smooth swinging motions of the bow guides.

SUMMARY OF THE INVENTION

The above discussed and/or other deficiencies of the prior art are overcome or alleviated by the present invention. An exemplary embodiment of the present invention is a flyer bow having a first surface and a second surface in opposition to the first surface. The first and second surfaces are joined to form an airfoil shape. A channel passes through the flyer bow between the first and second surfaces and a wire guide is disposed within the channel. There is at least one orifice through one of the first and second surfaces thereby establishing fluid communication between the channel and the atmosphere.

DESCRIPTION OF THE PREFERRED EMBODIMENT

Figure 1:
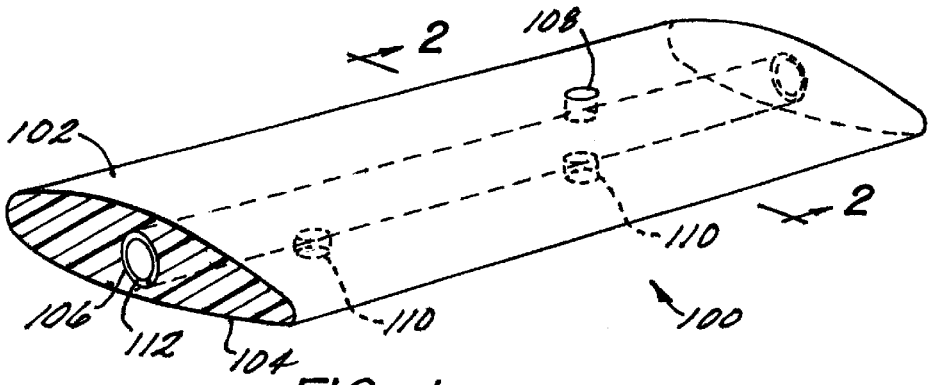
FIG. 1 is a three dimensional representation, in cross section, of a segment of the flyer bow in an embodiment of the invention.
Figure 2:
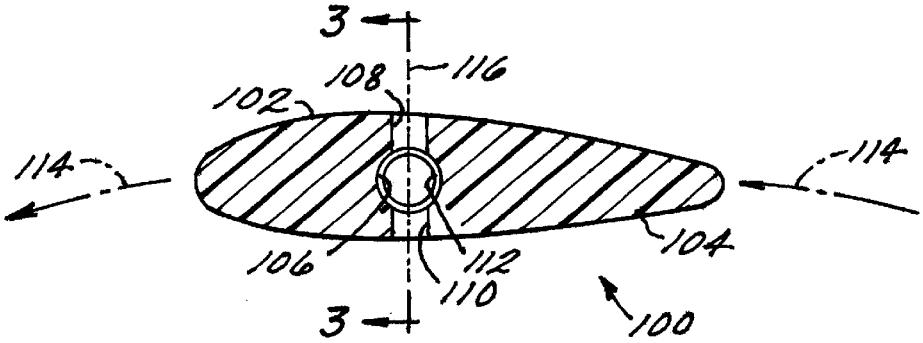
FIG. 2 is a first cross sectional view of the flyer bow in an embodiment of the invention.
Figure 3:
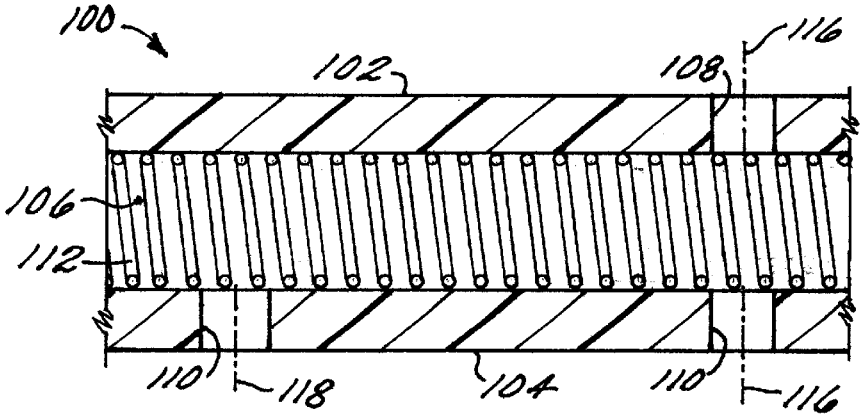
FIG. 3 is a second cross sectional view of the flyer bow in an embodiment of the invention.

A description of the preferred embodiment of the present invention will now be had, by way of exemplification and not limitation, with reference to FIGS. 1, 2 and 3. FIG. 1 is a three dimensional representation, in cross section, of a segment of a flyer bow 100. The flyer bow 100 comprises a first surface 102 and a second surface 104 in opposition to the first surface 102. The first surface 102 and second surface 104 are joined so as to form an airfoil shape in cross section. As seen in FIG. 1, the flyer bow 100 includes a channel 106 passing through and along the length of the flyer bow 100 between the first surface 102 and the second surface 104. Still further, the flyer bow 100 includes an internal wire guide 112. The wire guide 112 is disposed within the channel 106 so as to be coaxial therewith along the full length of the channel 106. A shown in FIG. 1, flyer bow 100 further includes at least one first orifice 108 extending through the first surface 102 and into channel 106. A second orifice 110 extends through second surface 104 and into channel 106. The first orifice 108 and second orifice 110 each establish fluid communication between the channel 106 and the ambient atmosphere.

Reference is now made to FIG. 2. FIG. 2 is a first cross sectional view of the flyer bow 100 in an embodiment of the invention. As best understood from FIG. 2 the flyer bow 100 is operative to be set in motion along an arc designated by the reference numeral 114. As a consequence of the aforesaid motion of the flyer bow 100 in conjunction with the air foil shape of the flyer bow 100 an area of relatively high pressure is developed over the second surface 104 and an area of relatively low pressure is developed over the first surface 102. This pressure differential between the first surface 102 and the second surface 104 is such as to create a flow of ambient fluid from the area of high pressure to the area of low pressure through the second orifice 110, the channel 106 and the first orifice 108. Such flow of fluid sweeps the channel 106 free of debris which accumulates due to the motion of the wire through the wire guide 112 and which would otherwise accumulate in channel 106 and restrict the movement of a wire through therethrough. The first and second orifices 108, 110 may be parallel to the center line 116 or may be at an angle thereto to maximize aerodynamic performance and minimize noise of the flyer bow 100. The wire guide 112 may be an open wound spring having sufficient gaps between turns to allow debris to freely exit channel 106. It is understood that structures other than open wound springs may be used for the wired guide 112 as long as openings are provided in the wire guide to allow debris to exit channel 106.

Reference is now made to FIG. 3. FIG. 3 is a second cross sectional view of the flyer bow 100. As best understood from FIG. 3, the first orifice 108 and second orifice 110 may be positioned along the channel 106 so as to be aligned along a first axis 116.

Alternatively, the first orifice 108 and second orifice 110 may be offset from one another wherein the first orifice 108 is aligned along the first axis 116 and the second orifice 110 is aligned along a second axis 118. As shown in FIG. 3, the wire guide 112 is disposed within the channel 106 so as to be coaxial therewith along the full length of the channel 106.

Flyer bow 100 may also include a mounting mechanism to secure the wire guide spring 112 within the cross section of the flyer bow 100. The mounting mechanism is designed such that a worn wire guide spring 112 can be easily removed from the flyer bow 100 and replaced with a new one. Using this mechanism, the existing flyer bow can continue to be used, thus extending the life cycle of the flyer bow. The wire guide spring mounting mechanism may include a set-screw or mounting plate which engages the wire guide 112.

The above-described exemplary embodiment of the invention alleviates the problem of drag on the exposed wires by incorporating the wire guide within the cross section of the flyer bow. Specifically, the open wound spring which fits within the cross section of the flyer bow is used as the wire guide. The wires to be twisted pass through the spring during operation of the twisting machine. In this manner, the wires are maintained within the flyer bow and are fully protected from wind and drag during the twisting process which can place tension on and stretch the wire, thereby degrading the wire quality. In addition, drag due to exposed wire guides has been eliminated. This configuration results in the ability to achieve a higher speed of rotation of the flyer bow without overloading the drive motor. Thus, speed of operation, and hence productivity, can be increased without a corresponding increase in costs. This configuration also reduces power consumption of the wire machine at a constant machine speed, thus saving costs.

The internal wire guide of the invention can be incorporated into flyer bows with traditional rectangular shape cross sections or airfoil shaped cross sections. As with other flyer bows known in the art, the flyer bow of this invention can be made of various materials. Preferred materials include braided fibers such as carbon/graphite, glass, aramid or polyester impregnated with a thermosetting polymer such as epoxy, unsaturated polyester, vinyl ester or phenolic and molded to form the desired shape.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A flyer bow comprising:

a first surface;

a second surface in opposition to the first surface;

said first and second surface joined to form an airfoil;

a channel passing through the flyer bow between the first and second surface; and a plurality of discrete orifices formed in said airfoil, said orifices being in fluid communication with the channel and ambient atmosphere.

2. A flyer bow comprising:

a first surface;

a second surface in opposition to the first surface;

a first surface and second surface joined to form an airfoil;

a channel passing through the flyer bow between the first and second surface; and at least one orifice in said airfoil in fluid communication with the channel and ambient atmosphere; and a wire guide disposed within the channel.

3. The flyer bow as set forth in claim 1 wherein the at least one orifice is disposed in the first surface.

4. The flyer bow as set forth in claim 1 wherein the at least one orifice is disposed in the second surface.

5. A flyer bow comprising:

a first surface;

a second surface in opposition to the first surface;

said first and second surface joined to form an airfoil;

a channel passing through the flyer bow between the first and second surface; and a plurality of orifices in said airfoil in fluid communication with the channel and ambient atmosphere;

wherein a first orifice of the plurality of orifices is disposed in the first surface and a second orifice of the plurality of orifices is disposed in the second surface.

6. The flyer bow as set forth in claim 5 wherein the first orifice of the plurality of orifice and the second orifice of the plurality of orifices are disposed along a common axis.

7. The flyer bow as set forth in claim 5 wherein the first orifice of the plurality of orifices and the second orifice of the plurality of orifices are disposed along separate axes.

8. The flyer bow as set forth in claim 2 wherein the wire guide includes openings for passage of debris from said channel.

9. The flyer bow of set forth in claim 8 wherein said wire guide is an open wound spring.

10. The flyer bow as set forth in claim 1 wherein a first orifice of the plurality of orifices is disposed in the first surface and a second orifice of the plurality of orifices is disposed in the second surface.

11. The flyer bow as set forth in claim 10 wherein the first orifice and the second orifice are disposed along a common axis.

12. The flyer bow as set forth in claim 10 wherein the first orifice and the second orifice are disposed along separate axes.

13. The flyer bow as set forth in claim 1 further comprising a wire guide disposed within the channel.

14. The flyer bow as set forth in claim 13 wherein the wire guide includes openings for passage of debris from said channel.

15. The flyer bow of set forth in claim 14 wherein said wire guide is an open wound spring.

16. The flyer bow as set forth in claim 2 wherein the at least one orifice is disposed in the first surface.

17. The flyer bow as set forth in claim 2 wherein the at least one orifice is disposed in the second surface.

18. The flyer bow as set forth in claim 2 wherein said at least one orifice includes a first orifice disposed in the first surface and a second orifice disposed in the second surface.

19. The flyer bow as set forth in claim 18 wherein said first orifice and said second orifice are disposed along a common axis.

20. The flyer bow as set forth in claim 18 wherein a first orifice of the plurality of orifices and a second orifice of the plurality of orifices are disposed along separate axes.

21. The flyer bow as set forth in claim 5 further comprising a wire guide disposed within the channel.

22. The flyer bow as set forth in claim 21 wherein the wire guide includes openings for passage of debris from said channel.

23. The flyer bow of set forth in claim 22 wherein said wire guide is an open wound spring.

* * * * *